US006851420B2

(12) United States Patent
Jennings

(10) Patent No.: US 6,851,420 B2
(45) Date of Patent: Feb. 8, 2005

(54) BURNER WITH PILOTING PORTS

(75) Inventor: Ralph Ernest Jennings, Westminster, CA (US)

(73) Assignee: BSH Home Appliances Corporation, Huntingdon Beach, CA (US)

( * ) Notice: Subject to any disclaimer, the term of this patent is extended or adjusted under 35 U.S.C. 154(b) by 0 days.

(21) Appl. No.: 10/256,531

(22) Filed: Sep. 27, 2002

(65) Prior Publication Data

US 2003/0024525 A1 Feb. 6, 2003

Related U.S. Application Data

(63) Continuation of application No. 09/292,690, filed on Apr. 15, 1999, now abandoned.

(51) Int. Cl.[7] ..... F24C 3/08

(52) U.S. Cl. ..... 126/39 R; 431/347; 431/349

(58) Field of Search ..... 126/39 R, 39 E, 126/39 A, 39 N, 215; 431/286, 349, 347; 239/556–559, 567

(56) References Cited

U.S. PATENT DOCUMENTS

| | | | |
|---|---|---|---|
| 1,125,726 | A | 1/1915 | Ruppel |
| 1,214,819 | A | 2/1917 | Parks |
| 1,285,733 | A | 11/1918 | Kennedy |
| 1,781,386 | A | 11/1930 | Harner et al. |
| 1,781,623 | A | 11/1930 | Zink |
| 1,806,800 | A | 5/1931 | Herrenbruck |
| 1,879,776 | A | 9/1932 | Toelle |
| 1,896,082 | A | 2/1933 | Harper |
| 1,921,778 | A | 8/1933 | Roberts |
| 1,971,449 | A | 8/1934 | Harper |
| 2,074,966 | A | 3/1937 | Kahn |
| 2,081,507 | A | 5/1937 | Reedy |
| 2,138,925 | A | 12/1938 | Kahn |
| 2,320,754 | A | 6/1943 | Sherman |
| 2,485,145 | A | 10/1949 | Evans |
| 3,399,024 | A | 8/1968 | Branson |
| 3,592,180 | A | 7/1971 | Kweller et al. |
| 3,597,135 | A | 8/1971 | Kweller et al. |
| 3,627,462 | A | 12/1971 | Lotter |
| 3,825,404 | A | 7/1974 | De Gouville |
| 4,565,523 | A | 1/1986 | Berkelder |
| 4,572,154 | A | 2/1986 | Schweitzer |
| 4,827,898 | A | 5/1989 | Liao et al. |

(List continued on next page.)

FOREIGN PATENT DOCUMENTS

| | | | |
|---|---|---|---|
| DE | 2 121 103 | | 4/1971 |
| EP | 719982 | A1 * | 7/1996 |
| GB | 2153988 | A | 8/1985 |
| GB | 2240168 | A | 7/1991 |
| JP | 54145030 | | 11/1979 |
| JP | 55-33528 | | 3/1980 |
| JP | 55102808 | | 8/1980 |
| JP | 5952113 | | 3/1984 |
| JP | 60245929 | | 12/1985 |

*Primary Examiner*—Sara Clarke
(74) *Attorney, Agent, or Firm*—John T. Winburn

(57) ABSTRACT

A cooking appliance includes burners having ports that are aligned in a defined alignment with respect to an adjacent structure of a burner body or the cooking appliance within a piloting zone so that the adjacent structure guides the formation of a flame kernel at an outlet of the port. The adjacent structure may be ports which also form flame kernels withing the piloting zone of the burner port outlet, a structural portion of the burner body such as an extended lip protruding beyond the burner port or a separate structure such as a flame rod or other target that stabilizes the flame kernels at the burner port outlet. Such structures provide a method for improving the turndown ratio of burners by preventing lifting or backlash of the flame kernels generated at the burner port outlets by aligning the ports in conjunction with an adjacent structure within a piloting zone.

8 Claims, 5 Drawing Sheets

U.S. PATENT DOCUMENTS 5,133,658 A 7/1992 Gouville et al.
5,328,357 A 7/1994 Riehl
5,391,076 A 2/1995 Home
5,397,234 A 3/1995 Kwiatek
5,405,263 A 4/1995 Gerdes et al.
5,468,145 A 11/1995 Ferlin
5,628,302 A * 5/1997 Schatz et al. ..... 126/215
5,765,542 A 6/1998 Fey et al.
5,899,681 A * 5/1999 Maughan ..... 431/349
D414,377 S 9/1999 Huang
5,954,492 A 9/1999 Lannes et al.
6,030,207 A 2/2000 Saleri
6,082,994 A 7/2000 Grandveau et al.
6,146,132 A 11/2000 Harneit
6,263,868 B1 7/2001 Koch et al.
6,299,436 B1 10/2001 Huang
6,371,754 B1 4/2002 Haynes

* cited by examiner

BURNER WITH PILOTING PORTS

CROSS-REFERENCE TO RELATED APPLICATIONS

This application is a continuation of U.S. application Ser. No. 09/292,690 filed Apr. 15, 1999 abandoned.

BACKGROUND OF THE INVENTION

1. Field of the Invention

The present invention relates generally to cooking appliances having gas burners with ports aligned to a predetermined relationship with adjacent structures to contribute to piloting of flame kernel patterns.

2. Background Art

Many previously known cooktops using gas burners include circular burners in order to provide a ring of ports that distribute heat at a consistent radial dimension from the burner. Such burners form a circular ring of flame kernels adjacent the outlet of the ports in the burner. Typically, the radial alignment of the ports limits interaction of the flame kernels generated at the ports, and as a result, limits the turndown ratio, the ratio of a burner's energy output per unit time (power, expressed in BTU per/hour) at maximum gas flow rate divided by the power at the minimum sustainable gas flow rate. The resulting flame kernel is then limited by the size of the port, and the limited range of gas flow rates, and is not otherwise controlled for stability. Operation of the burner at the flow rates beyond a limited range within the maximum and minimum flow rates causes lifting of the kernel away from the outlet of the port or flashback in which the kernel germinates within the port, within the primary gas passageway communicating with the port or within both. Such flame kernels are unstable and may be extinguished under variable ambient conditions. Such reactions may reduce the effective heating capacity of the burner under normal operating conditions.

In order to reduce cold spots that may occur centrally over the circular burners and within the ring of flame kernels, some burners have been formed with other configurations. For example, barbeque grills may employ elongated tube burners or U-shaped tube burners to distribute flame kernels throughout a cooking chamber. However, while such burners change the effective heating area in the cooking chamber, the ports in the previously known tube burners may be subject to the same problems of flame kernel instability. Moreover, although it has been known to cover the burner tubes with sear bars or the like in order to adjust heat distribution throughout the cooking chamber flow patterns in the cooking chamber may exacerbate flame instability. In addition, although cooktops have been known to be sealed to prevent the leakage of drips from a cooking surface entering the ports from which the flame kernels emanate, the use of previously known low profile burner structures to improve the stability of cooking vessels and reduce flame exposure often interferes with flame kernel stability.

SUMMARY OF THE INVENTION

The present invention overcomes the above mentioned disadvantages by providing a method for improving turn down ratio in a cooking appliance, as well as providing burner constructions and installations that generate flame kernel stability, through piloting. As used in this application, the term piloting is used to refer to contributions to control of the formation and the positioning of flame kernels as they emanate from the burner port outlets.

In general, a burner body has at least one burner port in communication with the primary air passage and having a defined alignment with respect to an adjacent structure that guides the formation of a flame kernel at the outlet of the port. The adjacent structure may be on the body, for example, a burner cap, on a separate element or be created by the orientation of an adjacent burner port or ports. For example, ports aligned for overlapping kernel generation at the outlets of the adjacent ports, or a port having an axis aligned at a converging angle with respect to an axis of the adjacent port outlet may provide interport piloting. In addition, adjacent ports may be positioned within an interport piloting distance of the flame kernel or aligned to provide an overlapping kernel generation at the outlets of the ports. Furthermore, the flame kernels may be stabilized by the burner construction to introduce self-piloting or by the interaction of the adjacent surfaces or shapes that may act as flame holders and stabilize the flame kernels.

In one illustrated embodiment, a multiple fingered burner includes multiple ports along each finger, a plurality of the fingers including ports that are angled, preferably acutely, away from a hub connecting the fingers to introduce interport piloting of the ports extending along the sides and ends of the fingers. In another illustrated embodiment, the adjacent structure for piloting can be provided by an external member of the appliance such as a sear bar of gas cooking grill, a flame rod or a part of the burner itself such as a lip of the burner cap extending over the burner ports. Nevertheless, regardless of the structure chosen to provide piloting for the ports, the outlet is positioned within an interport piloting distance for a flame kernel emitted from the outlet of the burner port. Moreover, regardless of the construction, the apparatus provides a method for improving turn down ratios and cooking efficiency by aligning at least one port to a defined alignment with respect to adjacent structure that guides formation of a flame kernel at an outlet of the port. When the adjacent structure is another port and the flame kernel that emanates from the other port's outlet, overlapping kernel generation may be employed to improve the stability of the flame kernels, although exterior or burner structures may likewise be positioned at a piloting distance from the outlet in order to enhance flame kernel stability.

BRIEF DESCRIPTION OF THE DRAWINGS

The present invention will be more clearly understood by reference to the following Detailed Description of the Preferred Embodiment when read in conjunction with the accompanying drawing in which like reference characters refer to like parts throughout the views and in which.

DETAILED DESCRIPTION OF THE PREFERRED EMBODIMENT(S)

Figure 1:
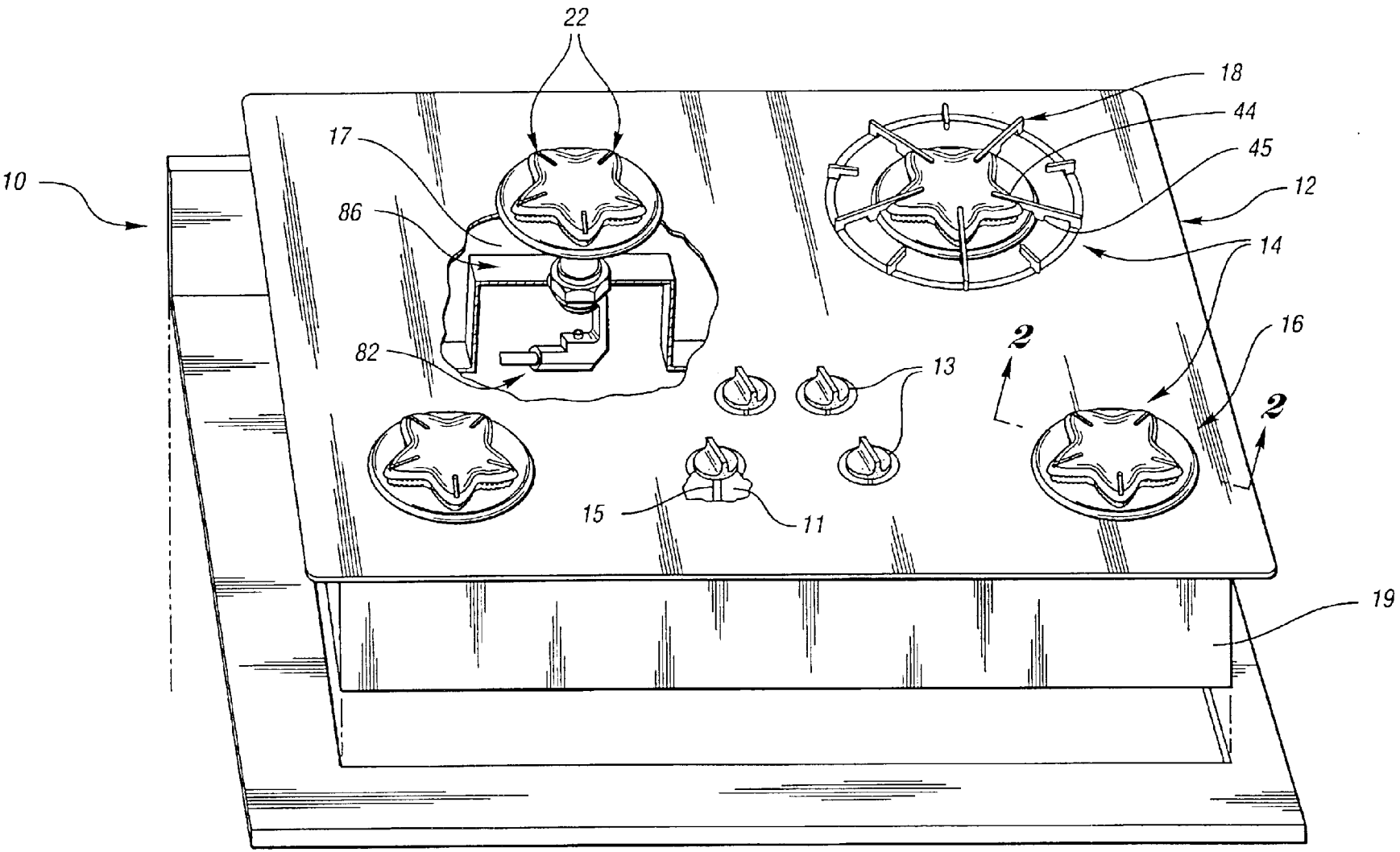
FIG. 1 is a fragmentary, perspective view of a cooking appliance constructed according to the present invention.

Referring first to FIG. 1, a cooking appliance 10 is shown having a cooktop 12 including a plurality of burners 14. The cooktop 12 includes surface panel 16 having a plurality of openings 17 defining the positions for each of the burners 14. Each burner supports a grate 18 to support a cooking utensil, such as a pot, pan or kettle over the burner. In the preferred embodiment, the surface panel 16 forms a sealed burner arrangement which is to be discussed in greater detail below. Nevertheless, the present invention is not limited to that context, and may also be employed with "open" burner arrangements that do not seal to a cooktop surface. In addition, control knobs 13 are carried on valve stems 15 protruding through openings 11 in the cooktop 12. The control knobs 13 are used to control the burner operation including the valve for controlling the flow of gas to the burner, and preferably, to also control the ignition of the burner in a well known manner, for example, as disclosed in U.S. Pat. No. 5,575,638.

In addition, the cooktop 12 carries a rough-in box 19 that encloses the cooktop control and burners for installation in a rough-in opening in a cabinet or counter top. The rough-in box 19 enclosure preferably includes a bottom wall to prevent spillage through cooktop openings 11 from soiling the interior of the cabinet. In addition, the bottom of the rough-in box 19 provides support for a bracket 86 used to support a jet holder 82 as described in greater detail below.

Figure 2:
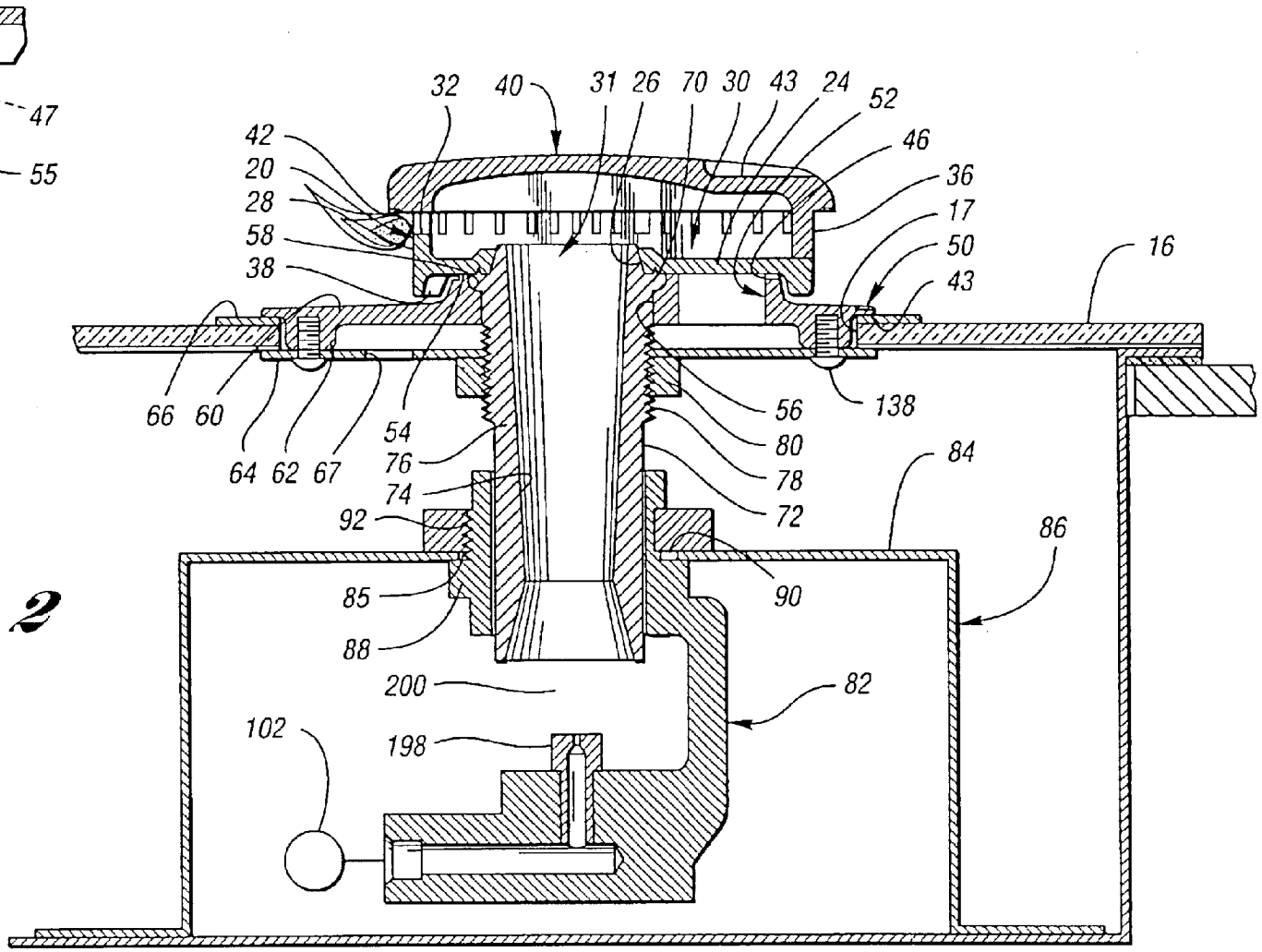
FIG. 2 is a sectional view taken substantially along the line 2—2 in FIG. 1.

Referring now to FIG. 2, a burner 14 includes a burner head 20 having a plurality of fingers 22 (FIG. 1) although it should be understood that the invention may be applied to burners of various shapes, including the previously known circular burners, so long as the port outlets are realigned with respect to an adjacent structure to cooperate in a piloting zone. In the Preferred Embodiment, the five fingers 22 form a star configuration. A central wall 24 of the burner head includes an opening 26. The central wall 24 and the peripheral wall 28 define a chamber 30. The upper portion of the peripheral wall 28 includes a plurality of recesses forming ports 32 in fluid communication with the chamber 30 and the exterior of the burner head 20. Although the recesses shown are open at the top, the cavities are closed at the top by the cap 40 only in the Preferred Embodiment. Moreover, the ports may also be formed wholly in the cap, wholly in the head, wholly in the base or between the head and the base without departing from the present invention.

The burner head 20 includes a support for a burner cap 40, for example, sockets for receiving legs 36 of the burner cap 40. The burner cap 40 includes a walled enclosure with an upper surface, the wall enclosing the chamber 30 and having a contour configured to cover the ports 32 with a lip 42 extending beyond the port outlets over each of the fingers 22 in the burner head 20. In the Preferred Embodiment, the upper surface of the burner cap 40 includes a plurality of recesses 43 (FIG. 2) adapted to receive a portion of a connector leg 44 (FIG. 1) of a grate 18.

The burner 14 also includes a base 50 having a base wall 60 and a support wall 52 including raised legs 54 that support the burner head 20 above the base 50. The support legs are preferably located at a position radially inwardly from the peripheral wall 28 of the burner head 20 as shown. The legs 54 define intermediate openings 46 that are arranged throughout the periphery of the base 50 for communicating with recesses that form ports 38 in the lower portion of the peripheral wall 28 of the burner head 20.

In addition, the burner base 50 also includes a central aperture 56 peripherally defined by a venturi seat 58. The base wall 60 conforms with the shape of the opening 17 in the cooktop for support of a burner 14 at the burner location. Preferably, a flange on the base 50, for example, the peripheral edge of wall 60, is slightly larger than the size of the opening 17 so that the base 50 of the burner seals against the surface panel 16 and prevents leakage of food products, overspills and the like from falling into the burner and related parts carried in the interior of the appliance 10. Similarly, the burner base 50 includes at least one recess 43 for protruding portions 45 (FIG. 1) of the connector leg 44 to maintain the grate 18 in a fixed position on the cooktop 12 when the burner base 50 is indexed for proper positioning and mounted to the cooktop as discussed below. Nevertheless, the grate 18 may be easily lifted out of its maintained position to permit cleaning as well as removal or disassembly of the burner 14.

As also shown in FIG. 2, the bottom of the base wall 60 includes threaded bosses 62 received in the opening 17 of the surface panel 16, and the bosses 62 receive screws extending through openings 138 in a locking plate 64. The locking plate 64 is also preferably larger than the opening 17 in the surface panel 16 so that the surface panel, preferably made of glass, can be sandwiched between the outer edge of the base 50 and the locking plate 64 at the periphery of the opening 17 in the surface panel 16. Preferably, a gasket or trim ring 66 is lodged between the lower surface of the base wall 60 and the exposed surface of the surface panel 16 around the opening 17 to seal the burner 14 to the cooktop 12. The cooktop 12 is in turn secured to the counter top with the rough-in box 19 extending through the opening in the counter top. A seal such as a foam gasket is positioned between the edge of the cooktop and the counter top at the periphery of the opening in the counter top. In this manner, the cooktop 12 can be sealed in position in the cabinet, although it will be understood that other cooktop constructions such as a self-contained stove may also be used to support the cooktop 12 in a well known manner.

The burner base 50 retains the grate 18, the burner head 20 and the cap 40 in position by receiving portions of the legs on grate 18. Connector leg 44 and portion 45 are received in the recesses 42 and 43 in the cap 40 and the base 52, respectively. The legs 54 and 44 rest in sockets to restrict lateral displacement of the grate 18, but permit disassembly for cleaning once the grate 18 is removed by lifting it above the stacked burner parts 40, 20 and 50.

The burner ports 32 are in fluid communication with a primary air passage 31 that couples the supply of gas and air mixture to the ports regardless of the structures that form the passageway. In the preferred embodiment, a mounting flange 70 at the end of a venturi tube 72 is seated upon the venturi seat 58 (FIG. 2) and retained in position by the central wall 24 of the burner head 20. However, this assembly may be modified, for example, as the wall 24 and venturi tube 72 may be made in one piece. The venturi tube 72 includes a venturi passage 74 through an elongated body 76. The body 76 includes an exterior, threaded portion 78 adapted to receive the nut 80 to lock the venturi tube 72 into position on the secured burner base 50.

The lower end of the venturi tube body 76 is received in a jet holder 82. The jet holder 82 is carried by a wall 84 of a bracket 86 supported by the bottom wall of the rough-in box 19. The jet holder 82 includes a retainer sleeve 88 including an annular shoulder 90 abutting one side of the wall 84 while threaded portion 92 extends through an opening 85 in the wall 84. The threaded portion 92 receives a nut 94 to lock the jet holder 82 to the bracket 86.

The jet holder 82 positions a gas nozzle 198 for introducing gas for mixture with air and entry into the venturi passage 74 as is well known in the prior art. The nozzle is coupled to a supply of gas 102 and discharges the fuel to a mixing zone 200 adjacent the entry to the venturi passage 74.

Figure 2A:
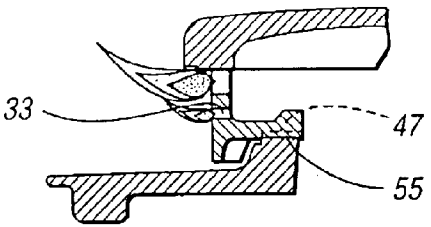
FIG. 2*a* is an enlarged partial sectional view taken along the line 2—2 in FIG. 1 illustrating the burner with an auxiliary burner port.

When each burner 14 is installed as shown in FIG. 2, and the supply 102 of gas delivered through the nozzle 98 is mixed with air at the mixing zone 100 to form primary air, the primary air enters the primary air passage 31 including the venturi passage 74 and the chamber 30. The primary air mixture then passes from this primary air passage 31 through the burner ports 32 so that upon ignition by an appropriate ignitor (not shown), a flame may be initiated and form a kernel at the port outlet sustained in a proper position at the exterior of the burner head 20. In the preferred embodiment, secondary air passages may be formed by the ports 38 in the burner head 20, the intermediate spaces 46 between the legs 54 on the burner base, and the openings 67 in locking plate 64 as described in greater detail in co-pending application Ser. No. 955,002, filed Oct. 20, 1997 entitled MULTIPLE FINGERED BURNER and incorporated by reference herein. Appropriate indexing means for arranging the stack of burner parts, for example, a structure similar to the above described socket arrangement receiving support legs 54, but having one longer leg 55 in a recess 47 (FIG. 2*a*) in the head 20 may be included to properly index the burner head with the burner base, and tilt the burner body if not properly aligned for engagement.

Figure 3:
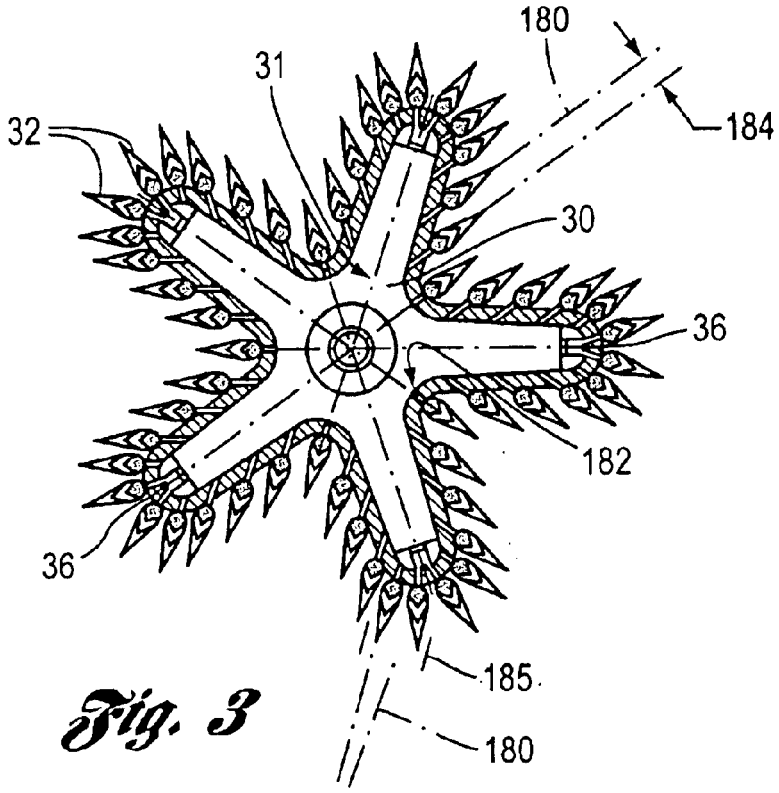
FIG. 3 is a fragmentary plan view of a burner shown in FIGS. 1 and 2 with portions of the burner cap removed for the sake of clarity.

Referring to FIG. 3, a plan view of the arrangements of the ports 32 shows the ports having axes aligned in a direction away from the finger connecting corners 182. The spacing 184 between the axes 180 may be aligned so that overlapping kernel zones are created to provide interport piloting in a piloting zone 184. In addition, it is to be understood that the angular alignment between the axes 180 of the adjacent port outlets may be made convergent to pilot the flame kernels in a common piloting zone 185, even where the spacing 184 between the outlets of adjacent ports is greater than an interport piloting distance between the adjacent outlets. As a result, the plurality of ports 32 are piloted by adjacent structure to provide stable flame kernels around the periphery of the burner. Likewise, the adjacent structure of the lip 42 may also contribute to piloting throughout the gas flow rate range to prevent the unstable flame conditions of lifting away from the outlet of the port 32 or flashback within the interior of the primary air passage 31 communicating with the ports 32. The interport piloting zone may be measured between the outlets of the ports 32 or between the axes of the ports at the outlet.

Moreover, if the axes 180 of the ports 32 are aligned to be converging, the compact converging flame kernels force the combustion to be completed in a reduced volume of space. As a result, smaller sized burners may emit greater heat than was previously possible, particularly where heat transfer efficiency may be improved to a small pot carried on the grate 18 over the burner. In addition, particularly where multiple fingered burners are employed, more heat is transferred closer to the center of the pot than was possible with the previously known circularly shaped burners. Moreover, the compact flame pattern provides the ability to operate with minimal head heights, that is the height at which cooking utensils may be supported above the top surface 16 of the cooking appliance in order to be positioned over the burners. Minimal head heights translate into the ability to operate burners under lower grates. Lower grates means that port stability can be maximized while at the same time providing clean, efficient combustion. These design features result in increased burner port stability, shorter, more stable flame kernels, better turn down ratios and the ability to operate the appliance with various and different types of gasses. Moreover, these flame patterns improve compatibility with thermocouples, spark igniters, flame sensors, and down draft vent systems. Moreover, the burner ports 32 may be sized differently in order to further modify the flame kernel size and the heating efficiency in accordance with the present invention. Moreover, burner ports 32 that are aligned at an angle to the wall thickness through the walls of the burner as shown in FIG. 3 provide longer burner ports that contribute to more stable flame kernels and can improve resistance to flashback and lifting. The burner may also be provided with auxiliary burner ports, as shown in phantom line at 33, to form auxiliary flame kernels, that may be smaller to merely pilot the larger kernels at the main ports 32.

Figure 5:
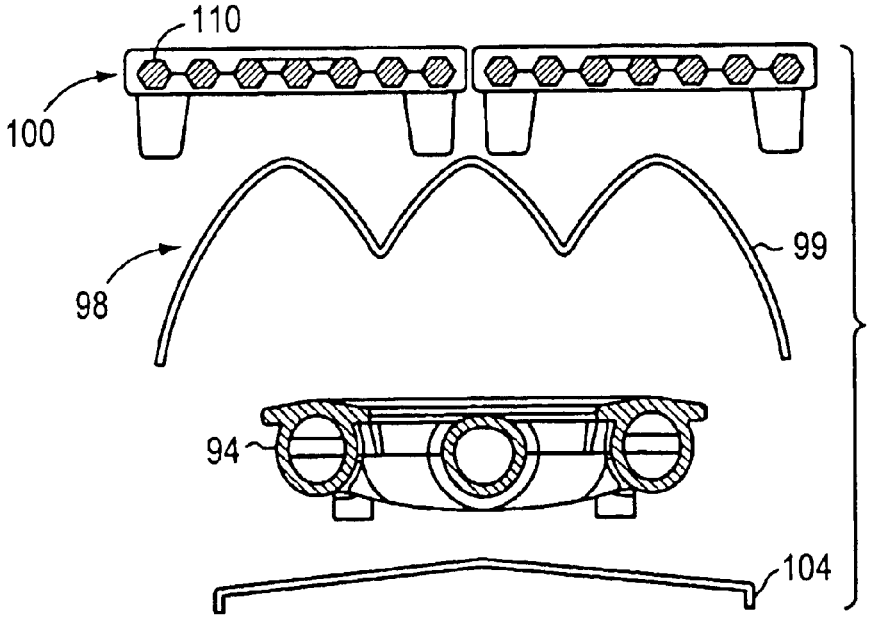
FIG. 5 is a front elevational view of the grill shown in FIG. 4.
Figure 4:
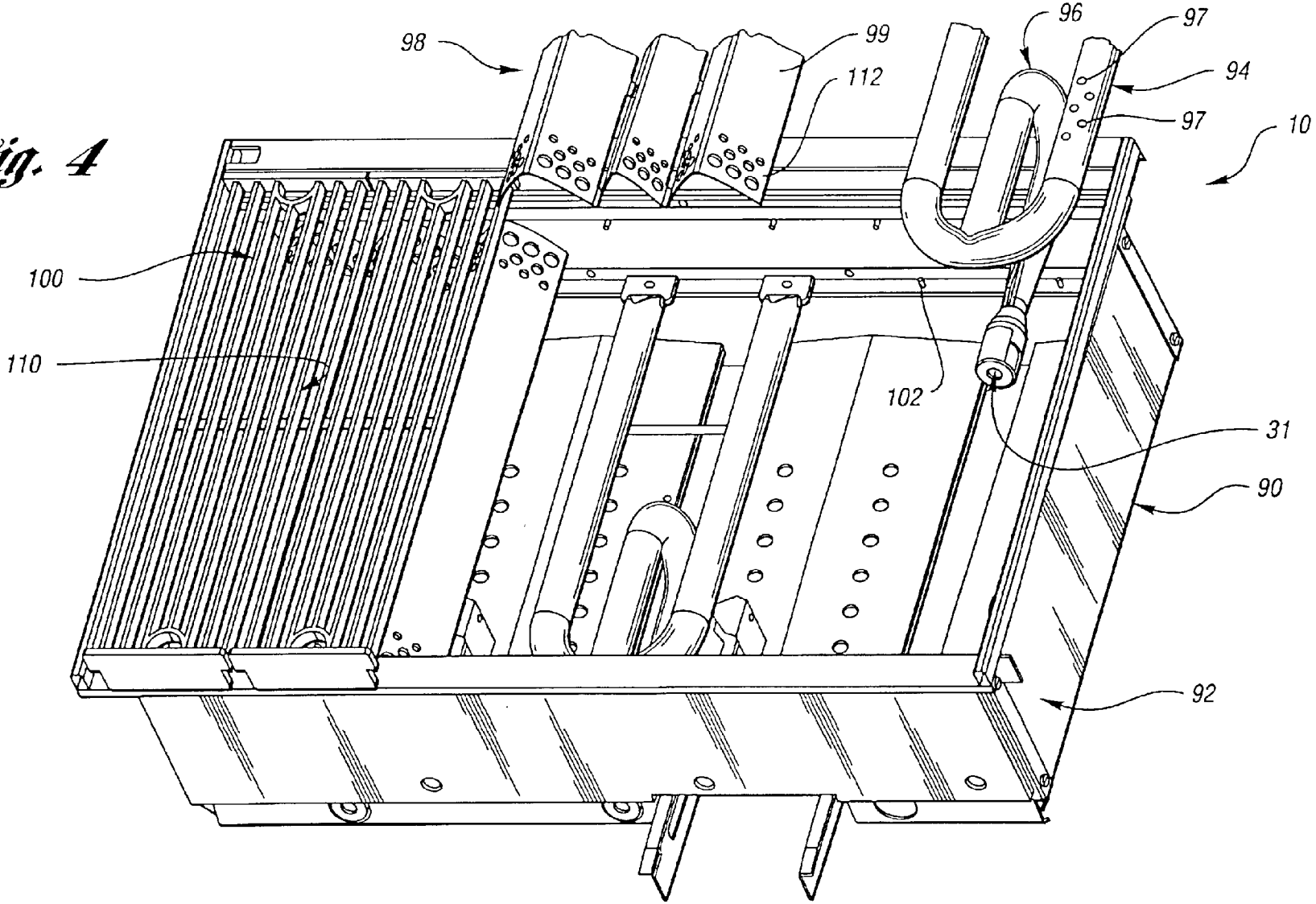
FIG. 4 is perspective view of a grilling appliance constructed with burners showing a different modification according to the present invention.
Figure 6:
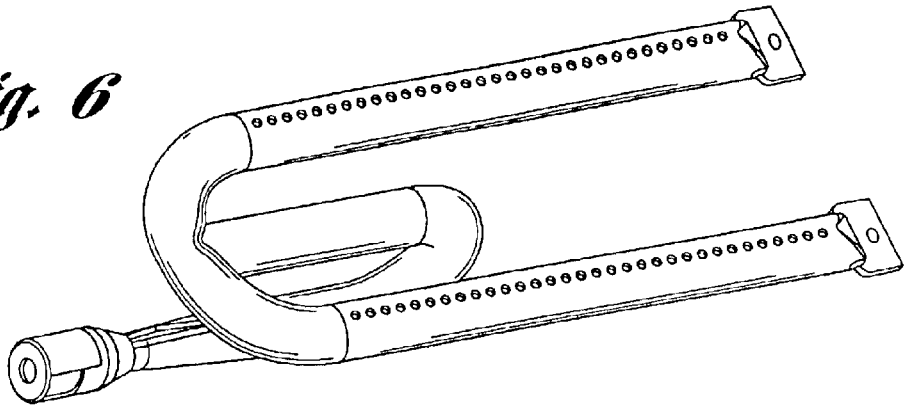
FIG. 6 is an enlarged perspective view of a burner from the grill shown in FIGS. 4 and 5.
Figure 6A:
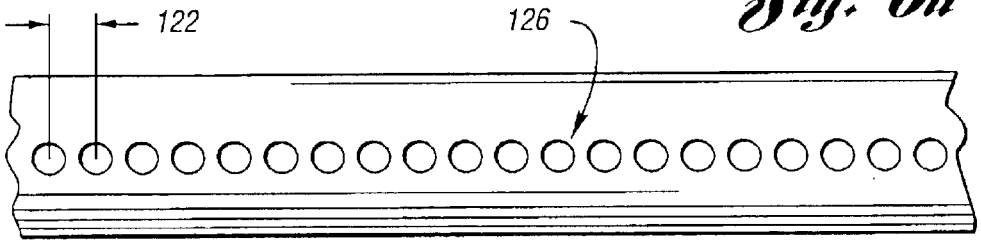
FIG. 6*a* is an enlarged side elevational view of the burner in FIG. 6 showing a modified pattern of ports for the burner.
Figure 6B:
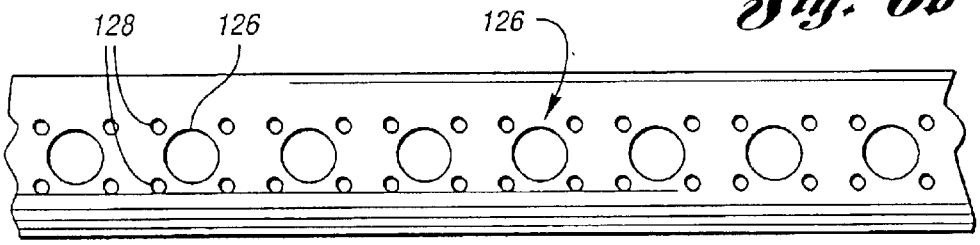
FIGS. 6*b*–6*d* are enlarged side elevational views similar to FIG. 6*a* but showing additional modified patterns of ports for the burner.
Figure 6C:
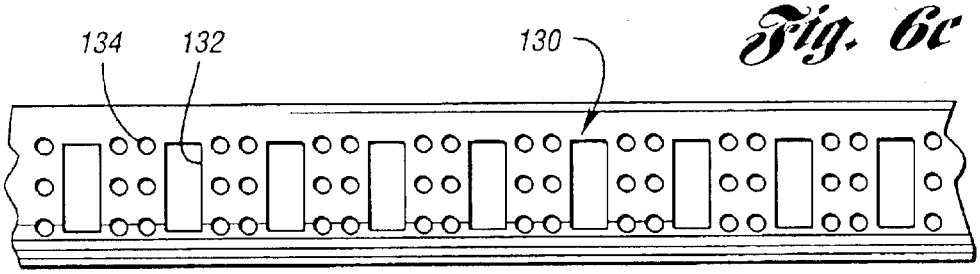
Figure 6D:
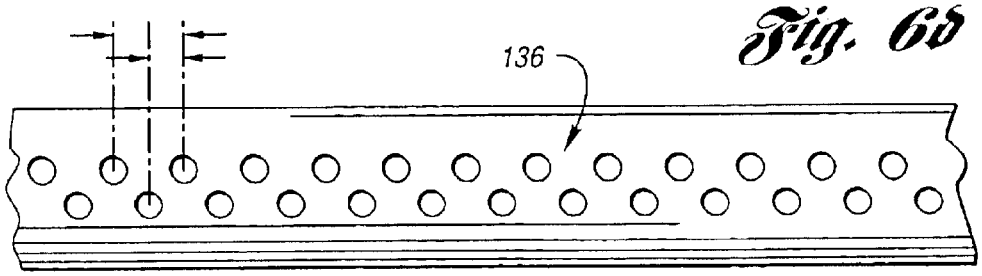

Referring now to FIGS. 4–6, the present invention is also applicable to other cooking appliances 10 with gas burners such as the barbecue grill 90. The barbeque grill 90 has a cooking engine assembly 92 that provides U-shaped burners 94 with flame ports 97 on the inside, on the outside, and on the top of the burner tubes, at various locations. The dispersion of ports along the tubes that spreads the heat source to provide more evenly distributed heat output within the grill chamber. In addition, the burners 94 have hollow tubes that communicate with the tubes of a second U-shaped connecting tube 96, preferably joined at one end to an inlet port on the front wall of the grill below the position of the first U-shaped burner tubes with ports, and also joined at the other end to the first U-shaped member. This structure 90 forms the primary air passage 31 that provides a cooler primary air mixture to the burners for more efficiency. The grill also improves the utilization of energy supplied by the fuel, and thus increases the heat output per/BTU input.

A more even heat distribution is also contributed to by the heated radiant panel 98. The distributor or radiant panel 98 preferably comprises one or more panels 99 of undulating shape, preferably formed with domes formed by parabolically rounded curves. A plurality of domes formed by the parabolic curves are coupled together by troughs, in a preferred radiant panel shape. The troughs are preferably apertured to control drainage of juices emanating from food cooked on a grid plate 100 formed of a plurality of grate panels 110 supported above the radiant panel 98. The generally parabolic shape of each of the dome walls provides a blunted, radiused peak at which the juices remain exposed to heat transfer for an extended period for vaporization of the juices. Preferably, the flame ports are positioned at the lowest portions of the radiant panel 98 so that rising heat converges at the peak of the dome where the blunted surface area maintains contact for heat transmission that evaporates most juices, grease, and fats. In addition, the radiant panel may act like a flame rod or other target structure having a defined alignment with the ports to provide an adjacent structure that guides the formation and positioning of a flame kernel at the ports. However, the burner ports in the illustrated embodiment are self-piloting as discusses below. Nevertheless, the dome surface drops at a steeper angle below the peak of the dome where the trough can collect and drain the unevaporated juices along controlled paths, preferably spaced from and not interfering with the flame kernels, without combustion and reducing flare-up.

The heating distribution control is also provided by a plurality of apertures 112 through the sides of the radiant panel walls, preferably positioned adjacent the ends of the dome-forming panels 98 adjacent the walls of the cooking chamber. The various sizes and shapes of the apertures, as well as the positions and the patterns of the apertures, control heat circulation throughout the chamber. Preferably, each radiant panel is supported by studs 102 protruding from the end walls of the cooking chamber. The studs, in the preferred embodiment, are spaced apart for receipt within two of the peaks in each panel, registering with studs 102 supported on an opposite wall of the grill housing, to stably support the panels in the grill between the cooking grid and the burners in the cooking chamber. A deflector plate 104 below each burner has inclined surfaces to control and cool the flow of cooking juices to the drip pan supported on the bottom of the cooking chamber. As a result, flare-ups of unburned fats and greases are reduced over previously known cooking grills with sear bars, ceramic briquettes and the like, while improving flavor due to searing and juice evaporation, and reducing cooking time with improved heat distribution.

When burners including an integrated, cast, grease shield may be used, the integrated grease shield may also form an adjacent surface that guides the formation and positioning of flame kernels at the ports of the burners. Such a structure may preferably include an overhanging lip such as the lip 42 of burners 14 described previously. The panels 98 may still be installed and are supported in a position that covers the burners for reducing flare-up activity when cooking fatty, greasy foods. The accelerating slope of the curved side surfaces of the radiant panel causes the fatty liquids and grease to vaporize as they strike and are retained upon the less steeply sloped, curved portion. Preferably, the tangent of the curves at the peak of the dome is greater than 90° to slow removal of the juice away from the peak at which heat energy converges. As any excess liquids which are not vaporized drip downward, the surface becomes more steeply curved causing liquids to drip along controlled paths through the slots and openings at the bottom of troughs formed between adjacent, curved side surfaces of the radiant. The ends of the panels 99 may be conveniently positioned adjacent side ports or top ports of the burners as shown in FIG. 5, to form a target surface separate from the burner 94, that acts as a flame rod to guide the formation and positioning of the flame kernels at the ports. As a result, material which may flare up is quickly removed from the cooking zone above the heat radiant panels. Nevertheless, the flavorizing effect in which caramelized sugars from evaporated liquids are transferred through vapor from the radiant heat distributor back onto the surface of the foods being cooked is provided and controlled while the flame kernels are stabilized.

Referring now to FIG. 6, various forms of interport piloting are illustrated in a single burner tube, although it would be understood that the variety of port arrangements is not so limited and that individual burner tubes may have one or more of these port arrangements. Moreover, the different port arrangements may be selected depending upon each burner's position within the cooking chamber. The burner portion 120 discloses a line of ports 32 that are close enough to permit the flame kernels generated at each outlet to be within the piloting zone 122 for the adjacent flame kernels. Burner portion 124 discloses a burner port arrangement in which a larger diameter port 126 is surrounded by a plurality of smaller diameter ports 128. A similar arrangement 130 discloses an elongated rectangular port 132 that is aligned within a plurality of round ports 134. Such arrangement permits substantially larger ports than was previously possible, and improves the turn down ratios of such ports since the use of auxiliary piloting ports stabilizes kernels resulting from large volume gas flow through the large gas ports. Nevertheless, it is to be understood that the alignment and arrangement of the ports may be further varied without departing from the present invention. For example, as shown at portion 136 of the burner 94, a staggered arrangement of ports wherein the flame kernel at each of the ports may be assisted by adjacent ports within a piloting zone 122 of a plurality of other ports.

Having thus described the present invention, many modifications will become apparent to those skilled in the art to which it pertains without departing from the scope and spirit of the present invention as defined in the pending claims.

What is claimed is:

1. A method for improving turn down ratio of a sealed gas burner having a burner body with a plurality of radially projecting fingers defining a plurality of peripheral ports above an orbicular base with a portion extending beyond the finger sealed to a cooktop comprising:

aligning at least one port of said plurality of peripheral ports to a defined alignment with respect to an adjacent structure positioned within a piloting zone at a proximal end of each finger over said extending portion of said base, wherein said adjacent structure guides formation of a flame kernel at an outlet of said at least one port.

2. The invention as defined in claim 1 wherein said adjacent structure comprises at least one second port of said plurality of ports, and wherein said aligning comprises overlapping kernel generation of said outlet of said at least one port and an outlet of said at least one second port.

3. The invention as defined in claim 1 wherein said aligning comprises positioning a non-flammable structure at a piloting distance from said outlet.

4. The invention as defined in claim 3 said structure is a part of said burner.

5. A gas burner for a cooking appliance comprising:

a burner body having a primary air passageway and a plurality of radially projecting fingers defining a plurality of peripheral ports in communication with said primary air passageway, at least one port of said plurality having a defined alignment with respect to an adjacent structure of said body at a proximal end of each finger, wherein said adjacent structure guides the formation of a flame kernel at an outlet of said at least one port, and wherein said body has an orbicular base extending beyond said fingers for supporting the burner and sealing a cooking appliance opening below the burner, and wherein said adjacent structure comprises at least one second port of said plurality of burner ports aligned for overlapping kernel generation at said outlet of said at least one port and an outlet of said at least one second port.

6. The invention as defined in claim 5 wherein said outlet of said at least one port is positioned within an interport piloting distance of a flame kernel emitted from said outlet of said at least one second port.

7. A cooking appliance comprising:

a housing;

at least one gas burner carried by said housing, said burner including a plurality of radially projecting fingers; and a grate supported above said burner;

wherein each said burner finger has a body with a plurality of lateral burner ports on each side of said finger, and at least one port of said plurality having a defined alignment with respect to an adjacent structure of said appliance, wherein said adjacent structure guides the formation of a flame kernel at an outlet of said at least one port and said adjacent structure is a sear panel.

8. A cooking appliance comprising:

a housing;

at least one gas burner carried by said housing, said burner including a plurality of radially projecting fingers; and a grate supported above said burner;

wherein each said burner finger has a body with a plurality of burner ports, and at least one port of said plurality having a defined alignment with respect to an adjacent structure of said appliance, wherein said adjacent structure guides the formation of a flame kernel at an outlet of said at least one port and said adjacent structure is a rod.

* * * * *